United States Patent [19]

Kraic

[11] Patent Number: 4,722,126

[45] Date of Patent: Feb. 2, 1988

[54] METHOD AND APPARATUS FOR THE MANUFACTURE OF A SINGLE-ROTATION MACHINE HAVING AN INTERNAL AXIS

[75] Inventor: Otto Kraic, Lindau-Enzisweiler, Fed. Rep. of Germany

[73] Assignee: Felix Wankel, Lindau, Fed. Rep. of Germany

[21] Appl. No.: 908,631

[22] Filed: Sep. 18, 1986

[30] Foreign Application Priority Data

Sep. 20, 1985 [CH] Switzerland ..... 04092/85

[51] Int. Cl.[4] ..... B23P 15/00; B23P 19/00; B25B 27/14; B23Q 3/00

[52] U.S. Cl. ..... 29/156.4 R; 29/428; 29/464; 29/700; 29/281.1

[58] Field of Search ..... 29/156.4 R, 428, 464, 29/700, 281.5; 60/598; 123/559, 560, 561, 562, 563, 564, 565; 418/166, 171

[56] References Cited

U.S. PATENT DOCUMENTS

| | | | |
|---|---|---|---|
| 724,994 | 4/1903 | Cooley | 418/166 |
| 748,348 | 12/1903 | Cooley | 418/166 |
| 2,621,603 | 12/1952 | Thomas | 29/156.4 R |
| 3,303,793 | 2/1967 | Morita | 418/166 X |

*Primary Examiner*—Howard N. Goldberg
*Assistant Examiner*—Ronald S. Wallace
*Attorney, Agent, or Firm*—Ladas & Parry

[57] ABSTRACT

The engagement parts of the external rotor of a single-rotation machine having an internal axis with sealing between its rotors and with respect to the machine casing by sealing gaps, are manufactured as single parts and following reciprocal alignment are joined at their two ends to in each case one circular side part. Alignment takes place by engaging the cross-sectionally arcuate outer faces of the engagement parts on arcuate parts of an assembly cage and by dimensionally accurate assembly bodies engaging between the engagement parts. The method permits narrower sealing gaps for the machine and consequently an improved efficiency.

7 Claims, 8 Drawing Figures

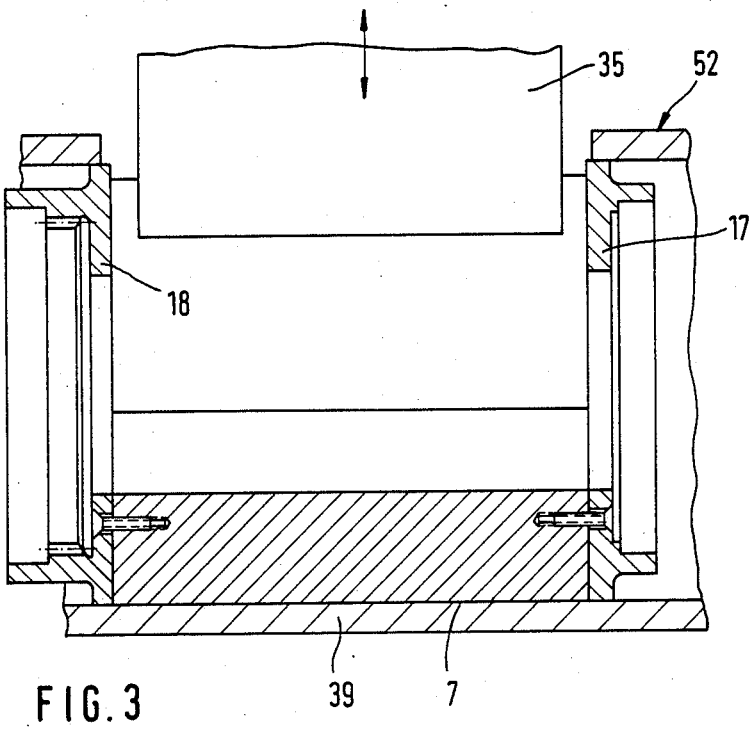
FIG. 3
FIG. 4
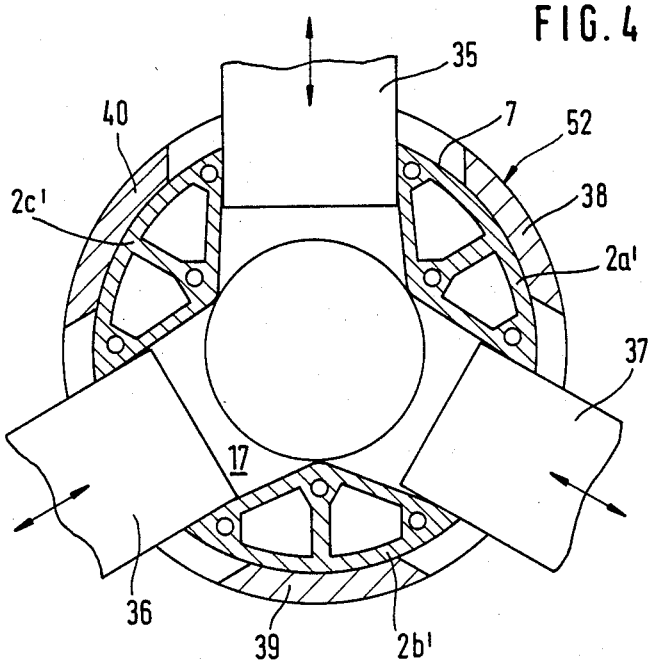

FIG. 7
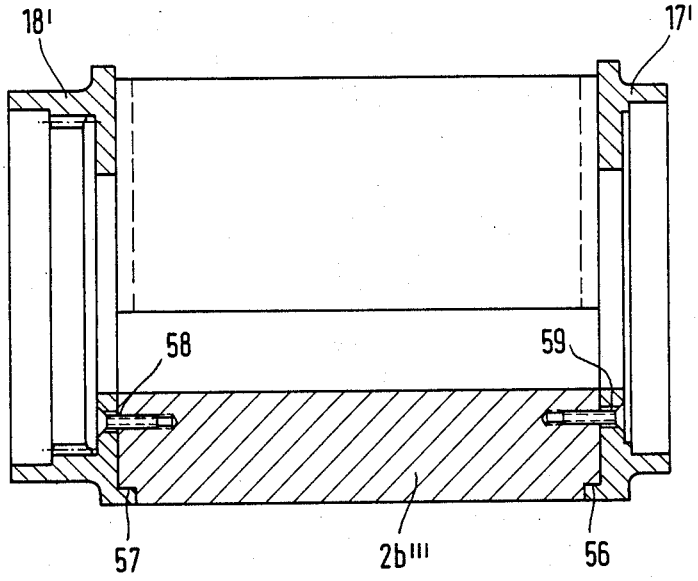
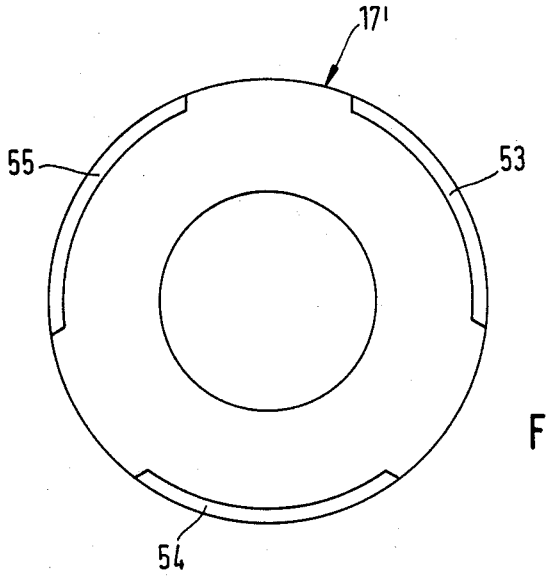
FIG. 8

METHOD AND APPARATUS FOR THE MANUFACTURE OF A SINGLE-ROTATION MACHINE HAVING AN INTERNAL AXIS

BACKGROUND OF THE INVENTION

The present invention relates to a method for the manufacture of a single-rotation machine having an internal axis, whose external rotor has at least three axially parallel, one-part engagement parts, which are interconnected by terminal side parts, the external and internal rotors being sealed with respect to one another and with respect to a casing forming a sealing gap.

The invention also relates to a single rotation machine manufactured according to the inventive method and to an assembly body for use in the inventive method.

Single-rotation machines having an internal axis, in which sealing does not take place by sealing ledges, have the advantage of low friction losses at the sealing points, because sealing takes place in a contact-free manner by the forming of a sealing gap by the parts moving relative to each other. Thus, such single-rotation machines are suitable for high rotational speeds so that, in the case of compact construction, they can be used as a supercharger on an internal combustion engine.

However, the accuracy of manufacture of known manufacturing methods is not adequate to obtain good sealing through narrow sealing gaps. Variations from the kinematically ideal shape are obtained on producing the curvature of the engagement surfaces of the two rotors and during the reciprocal association of the engagement parts of the external rotor in the tangential and radial direction, as well as during the assembly of the rotors relative to one another and relative to the surrounding casing. As the different divergences can be summated at specific sealing areas, it is necessary to provide wide sealing gaps, which take account of the summated maximum manufacturing and assembly tolerances, so as to prevent contact at the sealing points. The resulting wide sealing gaps of single-rotation machines manufactured in the conventional manner lead to poor machine efficiency as a result of sealing losses. The single-rotation machines of the above-mentioned type known from the literature have not gone into mass production as a result of the complicated, costly and imprecise manufacturing methods, or they are only provided for the passage of liquid media and operated at the relatively low rotational speeds suitable in such cases.

U.S. Pat. No. 1,753,476 shows a construction of a known single-rotation machine in which, for simplifying manufacture, it has been necessary to accept geometrically simple, but kinematically imprecise engagement faces with the resulting wide sealing gaps, so that it is only suitable for feeding relatively viscous media. Its external rotor is manufactured in one piece, its engagement parts are held at one side of a rotor side portion and can consequently only be loaded by limited centrifugal forces or can only have a short axial extension.

SUMMARY OF THE INVENTION

It is a primary object of the present invention to provide a method permitting a more accurate manufacture of a single rotation machine with more closely dimensioned sealing gaps and which is therefore suitable for gas feeding at high rotational speeds and with good efficiency.

In order to implement this object and still further objects of the invention, which will become more readily apparent as the description proceeds, the invention is characterized in that the engagement parts of the external rotor are manufactured as individual parts and are in each case joined at their two ends with one circular side part following reciprocal alignment, the alignment of the engagement parts taking place by engaging their cross-sectionally arcuate outer face on an assembly ring or arcuate parts of the side parts and assembly bodies engaging between the same.

BRIEF DESCRIPTION OF THE DRAWINGS

The invention is described in greater detail hereinafter relative to the the drawings, which show:

FIGS. 3 and 4 An axial and radial section through an external rotor supported by assembly parts.

FIG. 7 An axial section through another embodiment of an external rotor.

FIG. 8 A view of a bearing ring of the external rotor according to FIG. 7.

FIGS. 1 and 2 show a type of single-rotation machine, having an internal axis which is described in greater detail in the not previously published DE-A- 3 432 915 (a reference from the Federal Republic of Germany) of the same Applicant. Other constructions are described in the literature. The basic construction and other embodiments can, e.g., be gathered from the book entitled "Einteilung der Rotationskolbenmaschinen" (1963), Deutsche Verlags-Anstalt GmbH, Stuttgart or "Rotary Piston Machines", London, Iliffe, (1965).

Figure 1:
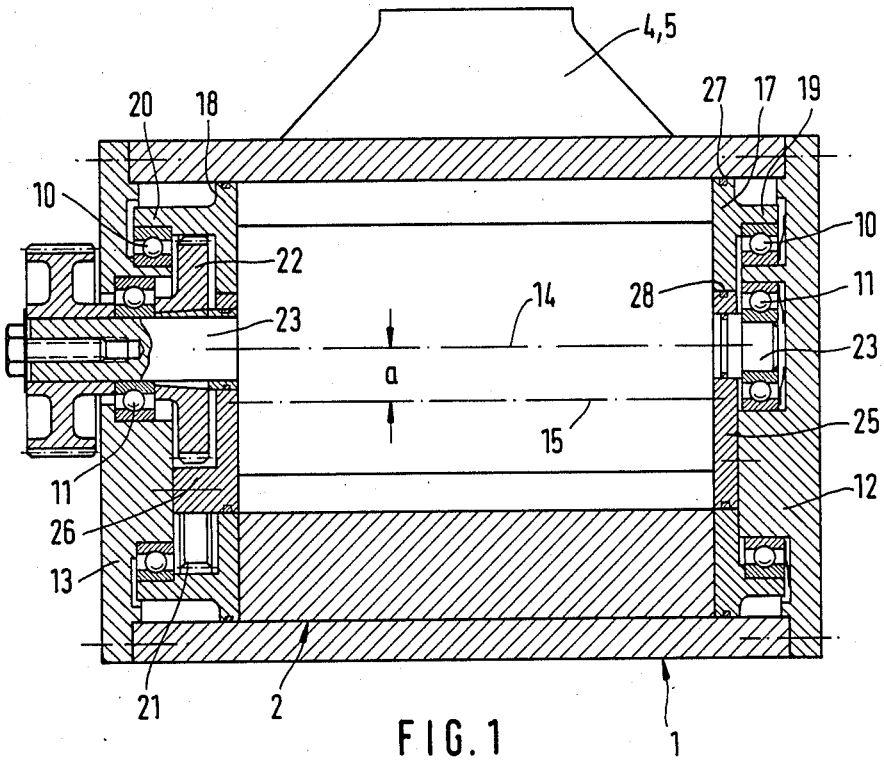
FIGS. 1 and 2 An axial and radial section through an embodiment of a single-rotation machine.
Figure 2:
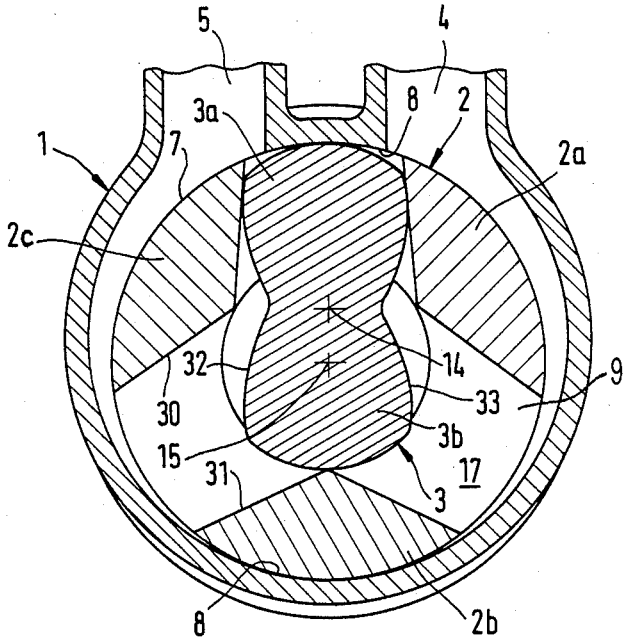

The represented machine has a speed ration between the external rotor 2 and the internal rotor 3 of 2:3, so that there are three engagement parts 2*a*, 2*b*, 2*c* on the external rotor and two engagement parts 3*a*, 3*b* on the internal rotor. The machine casing 1 is circumferentially provided with an intake port or passage 4 and an outlet port or passage 5, which are sealed with respect to one another by the sealing gap of the outer peripheral part 7 of engagement parts 2*a*, 2*b*, 2*c* and the inner face 8 of the casing.

The rotors 2, 3 are mounted by antifriction bearings 10, 11 which bear on side plates 12, 13 of casign 1. As a result of the spacing a between the geometrical axes 14, 15, the inner antifriction bearing 11 of internal rotor 3 has a radially displaced position within the surrounding outer antifriction bearing 10 of external rotor 2. For the mounting of external rotor 2, hubs 19, 20 are shaped on to its side parts 17, 18 and enclose the antifriction bearings 10. In addition, one part of one of these hubs 20 forms a hollow gear 21, with which meshes a spur gear 22, which is mounted on shaft 23 of internal rotor 3.

The side parts 17, 18 of external rotor 2 interconnect these three engagement parts 2*a*, 2*b*, 2*c* and together with a sealing member 25, 26 fixed to the casing sideplates 12, 13 seal the working spaces 9 of the machine in the axial direction. Correspondingly the side parts 17, 18 of external rotor 2 are in the form of circular rings, which are provided on the radial outside and radial inside with in each case one radial seal 27, 28. As said side parts 17, 18 carry as the bearing ring the engagements part *2a, 2b, 2c* of external rotor 2, the accuracy of the position of engagement parts *2a, 2b, 2c* relative to side parts 17, 18 is also decisive for the width of the sealing gaps between the outer circumferential surfaces 7 of engagment parts *2a, 2b, 2c* and the casing inner face 8.

Apart from the accuracy of the dimensions of engagment parts *2a, 2b, 2c* and those of the internal rotor 3, the accuracy of the position of engagment parts *2a, 2b, 2c* relative to the side parts 17, 18 in the tangential or circumferential direction is also decisive for the width of the sealing gaps between the inner faces 30, 31 of the external rotor 2 and the circumferential surfaces 32, 33 of internal rotor 3. The method according to the invention provides a way to permit accurate positioning of the engagement parts *2a, 2b, 2c* of external rotor 2 relative to the side parts 17, 18 of the latter in connection with minimum sealing gap widths and, as a result of the mounting thereof, define the position relative to the machine casing 1. Through the joining of the engagement parts *2a, 2b, 2c*, following their individual manufacture, to the side parts 17, 18 of the external rotor, limited dimensional difference of the engagement parts have no or only a limited effect on the sealing gap width, because dimensional differences are compensated by accurate positioning of the engagement parts.

As can be gathered from FIGS. 3 to 6, the positioning of the engagement parts *2a, 2b, 3c* or *2a', 2b', 2c'* relative to the side parts 17, 18 of the external rotor takes place by assembly bodies 35–37 engaging between the engagement parts and the bearing of their outer circumferential surfaces 7 on the outer arcuate parts 38–40. As a result of the construction of said assembly bodies 35–37 and the arcuate parts 38–40 as precision parts, a very accurate positioning is obtained, without any significant dimensional difference between a large number of mass produced external rotors. According to the embodiment of FIG. 6, the width of the assembly body 36" can be adjusted by means of an inserted spline 42, so that after insertion between the engagement parts *2a"* and *2c"* it can engage behind the corner regions thereof with lateral extensions 43, 44. Differing from the drawing, assembly bodies 35"–37" can be constructed in a width-variable manner. Preferably the crescent-shaped or circular segmental engagement parts *2a", 2b", 2c"* are provided in their corner regions with flattened portions 45, 46 running parallel to the side faces of assembly bodies 35"–37", which increases the accuracy of positioning by means of assembly bodies 35"–37".

Figure 5:
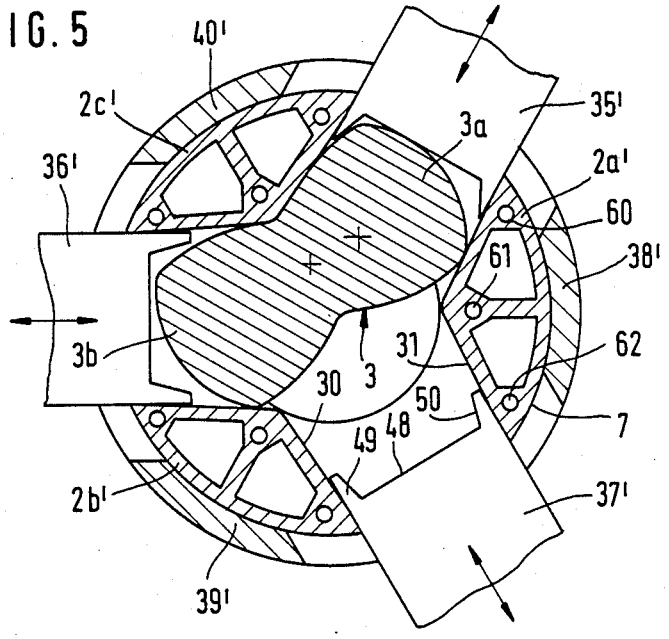
FIG. 5 An arrangement secured by assembly parts of an external rotor with an enclosed internal rotor.
Figure 6:
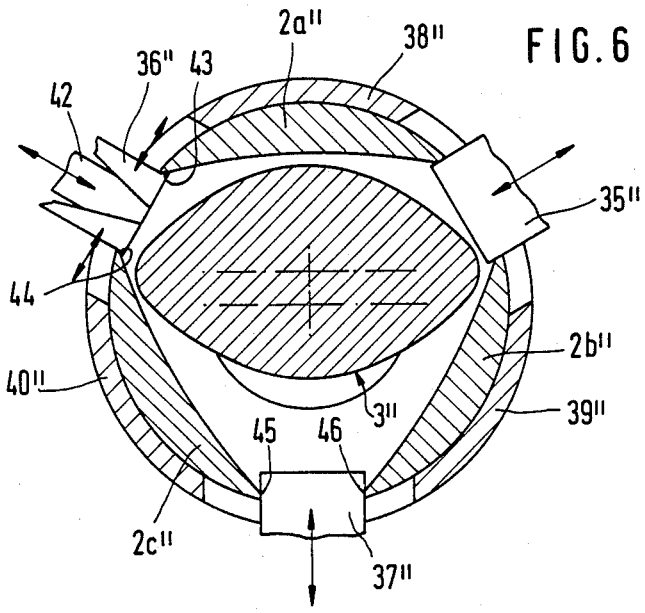
FIG. 6 An assembly arrangement for a further embodiment of a single-rotation machine.

The assembly bodies 35'–37' of the embodiment of FIG. 5 are frontally provided with recesses 48, so that lateral extensions 49, 50 exist which, despite the already inserted internal rotor 3, permit the assembly contact on a significant area of the inner faces 30, 31 of the engagement parts *2a', 2b', 2c'*, in that the engagement parts *3a, 3b* of internal rotor 3 engage between them. As a result of the assembly of engagement parts *2a', 2b', 2c'* on the side parts 17, 18 with internal rotor 3 already inserted and which is fixed in its position relative to side parts 17, 18 of external rotor 2 by the sealing members 25, 26 (FIG. 1), the engagement parts *2a', 2b', 2c'* can also be accurately fitted relative to the internal rotor 3. It is also possible to carry out the assembly or alignment of the engagement parts with already fitted antifriction bearings 10, 11 and attached casing side plates 12, 13. Engagement parts *2a', 2b', 2c'* are e.g. fixed by welds, which are provided on the outer circumference of external rotor 2.

The centering of engagement parts *2a, 2b, 2c* by means of arcuate parts 38–40 of an assembly cage 52 engaging on the outside thereof during assembly can be obviated if, according to the embodiment of an external rotor shown in FIGS. 7 and 8, arcuate parts 53, 54, 55, engaging in an outer edge slot 56, 57 of engagement parts *2b'"*, are shaped on to the outer edge of the side parts 17', 18'. These arcuate parts 53–55 with the ring-like side parts 17', 18' can be inexpensively and very accurately manufactured as turned parts.

The fixed connection between engagement parts *2a, 2b, 2c* and side parts 17, 18 or 17', 18' can take place by conventional joining means, such as adhesives, welds, or screws 58, 59, 60, 61, 62.

I claim:

1. A method for the manufacture of a single-rotation machine having an internal axis, said machine having a casing (1), an external rotor (2) having at least three axially parallel, engagement parts *(2a, 2b, 2c)*, each engagement part having a cross-sectionally arcuate outer face (7) and two ends, said engagement parts being interconnected by two terminal side parts (17, 18), said machine having an internal rotor (3), said external and internal rotors (2, 3) being sealed with respect to one another and with respect to said casing (1), forming a sealing gap between said external and internal rotors and between said external rotor and said casing, comprising the steps of (a) manufacturing the engagement parts *(2a, 2b, 2c)* of the external rotor (2) as individual parts;

(b) positioning the engagement parts relative to each other and to said casing such that the width of said sealing gaps are minimized, by engaging said arcuate outer face (7) on an alignment means selected from the group consisting of an assembly ring (52, 38–40) and arcuate parts (53–55) of said terminal side parts (17, 18), with assembly bodies (35–37) being engaged between said engagement parts *(2a, 2b, 2c)*; and (c) joining the two ends of each engagement part with each circular side part (17, 18).

2. The method according to claim 1, wherein said internal rotor (3) is positioned between said engagement parts *(2a, 2b, 2c)* of the external rotor (2) while positioning said engagement parts on the arcuate parts of the terminal side parts.

3. The method according to claim 2, wherein said positioning of the engagement parts *(2a, 2b, 2c)* takes place after inserting sealing members (25, 26) in said side parts (17, 18) of said external rotor (2), the internal rotor (3) having a shaft (23) extending through said sealing members (25, 26).

4. The method of claim 3 wherein said casing (1) has two side plates (12, 13), and antifriction bearings (11) are interposed between said internal rotor (3) and said side parts (17, 18) of the external rotor (2), and said positioning of the engagement parts *(2a, 2b, 2c)* takes place after fitting of said antifriction bearings (11) on said side parts (17, 18).

5. An assembly body used in the manufacture of a single-rotation machine, said machine having an internal axis, and said body being adapted to be engaged between engagement parts *(2a, 2b, 2c)* of said single-rotation machine, said machine having an external rotor (2) comprising at least three axially parallel engagement parts *(2a, 2b, 2c)* each having an inner face (30, 31), said assembly body comprising a front face provided with extensions (49, 50) for bearing on said inner faces (30, 31) of said engagement parts of said external rotor.

6. The assembly body of claim 5, wherein the width of the assembly body is adjustable.

7. The assembly body of claim 6, wherein said front face is provided with laterally projecting extensions (43, 44) for engaging behind corner regions of said engagement parts 2*a*'', 2*b*'', 2*c*'') of the external rotor (2).

* * * * *